United States Patent [19]

Vos et al.

[11] Patent Number: 4,611,608

[45] Date of Patent: Sep. 16, 1986

[54] PROCESS FOR UTILIZING TOBACCO DUST

[75] Inventors: Cornelis Vos; Jan Brasser, both of Huizen, Netherlands

[73] Assignee: Naarden International N.V., Naarden-Bussum, Netherlands

[21] Appl. No.: 570,359

[22] Filed: Jan. 13, 1984

[51] Int. Cl.[4] ..... A24B 3/14

[52] U.S. Cl. ..... 131/354; 131/355; 131/371

[58] Field of Search ..... 131/354, 355, 356, 371, 131/373, 374

[56] References Cited

U.S. PATENT DOCUMENTS

| | | | |
|---|---|---|---|
| 3,136,321 | 6/1964 | Davis | 131/371 |
| 3,386,450 | 6/1968 | Seligman | 131/354 |
| 3,988,487 | 10/1976 | Sanderson et al. | 131/276 |

FOREIGN PATENT DOCUMENTS 0069467 1/1983 European Pat. Off. .

*Primary Examiner*—V. Millin
*Assistant Examiner*—Gregory Beaucage
*Attorney, Agent, or Firm*—Michael N. Meller

[57] ABSTRACT

A process for utilizing tobacco dust by affixing it to cut, shredded or otherwise comminuted tobacco, reconstituted tobacco or tobacco substitute by thoroughly mixing tobacco dust, a powdered water soluble hydrocolloid, optionally an organic solvent, the comminuted tobacco, reconstituted tobacco or tobacco substitute, water or an aqueous solution of the hydrocolloid and optionally an additional quantity of the comminuted tobacco, reconstituted tobacco or tobacco substitute and continuing the mixing until a dry or almost dry product is obtained. The water soluble hydrocolloid may partly or completely be replaced by micro-encapsulated flavors, so that flavored tobacco products are obtained.

8 Claims, No Drawings

PROCESS FOR UTILIZING TOBACCO DUST

BACKGROUND OF THE INVENTION

This invention pertains to the field of tobacco, tobacco substitute and tobacco products. More particularly, this invention concerns a process for utilizing tobacco dust by affixing it to cut, shredded or otherwise comminuted tobacco, reconstituted tobacco or tobacco substitute.

During transport of tobacco and during the various stages of its processing into tobacco products, part of the tobacco breaks up and is left behind as dust. Since this dust constitutes a loss, various ways and means have been described to convert it into some product that is useful again in the tobacco industry. Thus, it has been used together with other tobacco waste in the preparation of reconstituted tobacco. However, the papermaking process, which is an important process for making reconstituted tobacco, cannot accommodate tobacco dust. U.S.S.R. Pat. No. 923,512 describes a method of converting tobacco dust into a fibrous material by first mixing it with some binding agent and an organic solvent, followed by extrusion, drying and cutting. European patent application No. 60,467 describes a process for affixing dust particles to tobacco by mixing them with part of the casing liquid and spraying this mixture on the cut tobacco. Preferably, the dust particles to be used in this process should not be greater than about 100 μm, whereas the size of most tobacco dust particles lies between 100 and 1000 μm. Therefore relatively complicated extra equipment is necessary to reduce the particle size of the dust, and ensure a homogeneous dispersion of the dust in the casing liquid.

European patent application No. 56,308 describes a process for agglomerating tobacco dust particles with some binding material and incorporating the larger particles thus obtained into reconstituted tobacco.

SUMMARY OF THE INVENTION

This invention provides a process for affixing tobacco dust to cut, shredded or otherwise comminuted tobacco-product, such as tobacco, tobacco substitute or reconstituted tobacco. The process accomodates dust particles of any size and requires only conventional mixing equipment. Tobacco treated according to the invention retains its original appearance.

The process according to the invention generally comprises the steps of thoroughly mixing tobacco dust with a powdered, water soluble hydrocolloid and with cut, shredded or otherwise comminuted tobacco, reconstituted tobacco or tobacco substitute, followed by finely dividing an aqueous solution of such hydrocolloid over the mixture, with continuous mixing. Mixing is further continued after the addition of the hydrocolloid solution until the solution has been substantially absorbed by the tobacco mixture and this shows a dry appearance. This may be aided by adding an additional quantity of comminuted tobacco, to absorb any remaining moisture. Alternatively the tobacco mixture may be further dried with air.

DETAILED DESCRIPTION

Water soluble hydrocolloids to be used in the process of the invention may be film forming hydrocolloids, comprising: vegetable and microbial gums, such as gum arabic, karaya, tragacanth, carragenan etc.; modified starches, such as dextrins, modified starches etc.; cellulose derivatives such as hydroxypropylcellulose, carboxymethylcellulose; gelatin, casein and similar proteins and polyvinylalcohol. Alternatively, saccharose and other saccharides which readily form a glass on drying, may also be used in the process of the invention and are for the purpose of this invention also comprised in the term "hydrocolloids". Of course, the hydrocolloids to be used must be allowed for use in tobacco.

The particle size of the powdered hydrocolloids should be less than 500 μm and preferably less than about 200 μm.

In the simplest embodiment of the invention an intimate mixture is made comprising: at least 60% by weight of the total mixture, and preferably 65% or more, of comminuted tobacco, reconstituted tobacco or tobacco substitute; at most 25% by weight and preferably not more than 20% by weight of tobacco dust and a quantity of powdered hydrocolloid described above which is at least 20% and preferably 30% w/w or more of the quantity of tobacco dust. 2–7% by weight (of the total mixture above) of plain water is sprayed or atomized over the mixture and mixing a continued until the mixture has a substantially dry appearance. In this way the hydrocolloid solution is prepared in situ during the mixing and therefore only easily and quickly soluble hydrocolloids may be used.

In an improved embodiment of the invention a separately prepared aqueous solution of an additional amount of hydrocolloid is sprayed or atomized over the mixture instead of plain water, in an amount of between 2 and 7% and preferably between 3.5 and 6% of the weight of the dry mixture.

The maximum concentration of hydrocolloid in this solution is determined by the maximum viscosity that can be accommodated by the spray head used to disperse the solution over the mixture. Solutions with a maximum viscosity of 400 cP may generally be used with spray heads with a working pressure of about 300 Bar. With low pressure spray heads (about 10–15 Bar max.) the viscosity should preferably not exceed 150 cP.

A further improvement of the process of the invention consists of spraying a small quantity of a water miscible organic solvent over the mixture and thorough mixing, prior to the addition of the hydrocolloid solution. It is believed that the beneficial action of the organic solvent is caused by a slow down of the absorption of water from the hydrocolloid solution by the tobacco and tobacco dust, thus resulting in a more homogeneous dispersion of the hydrocolloid solution through the bulk of the mixture. However, this explanation is only given for reasons of clarification and does not in any way limit the invention. Suitable organic solvents meet the following conditions: they do not, or only slightly dissolve the solid hydrocolloid; they are suitable for use in tobacco; they do not have an annoying odor or flavor of their own. Examples of such solvents are: ethanol, isopropanol, propylene glycol, gylcerol, diethylene glycol, triethylene glycol, butylene glycol.

The quantity of organic solvent to be used is not critical and 10% by weight based on the weight of the dry mixture may be easily accommodated. However, in most cases 6% or even less will suffice to obtain the desired improvement of the process.

In an advantageous embodiment of the invention, tobacco dust and powdered hydrocolloids are first thoroughly mixed together and preferably a small quantity of organic solvent as defined above is sprayed or atomized over the mixture. This quantity does generally not exceed 20% of the combined weight of tobacco dust and powdered hydrocolloid. Optionally up to 10% by weight of water or hydrocolloid solution is also sprayed over this mixture after the organic solvent has been added.

Mixing is continued until a substantially homogeneous mixture is obtained and subsequently the comminuted tobacco is added and mixed through, while the remainder of the organic solvent followed by the hydrocolloid solution are sprayed over the total mixture. Mixing is continued until the mixture has a substantially dry appearance. If desired, or necessary to obtain a completely dry product, drying may be completed by adding a fresh amount of comminuted tobacco to absorb the remaining moisture.

Further embodiments of the invention will be apparent to those trained in the art from the description given above. In any of these embodiments the powdered hydrocolloids may be partly or even completely replaced by micro encapsulated flavors. Such flavors are well known and extensively used in the food industry. They consist of microcapsules, generally measuring less than 500 μm, comprising small droplets or particles of a liquid or solid flavor, within a solid matrix or envelope of an edible hydrocolloid. They may be produced in several different ways, e.g. as described by L. I. Balassa and G. O. Fanger in CRC Critical Reviews in Food Technology, July 1971 pp. 245–264, which is hereby incorporated by reference.

Typically, they are produced by spray drying an emulsion or dispersion of a water-insoluble flavor in an aqueous solution of an edible gum, e.g. gum arabic, or a starch derivative e.g. some maltodextrin. Thus, not only tobacco dust, but at the same time micro-encapsulated flavor is affixed to the comminuted tobacco.

The process of the invention may be carried out using conventional mixing equipment. It is preferred to use a type of mixer which does not cause undue heating of the mixture or damage to the tobacco particles, even on prolonged mixing. Conical type blenders, ribbon blenders or fluidized bed blenders are particularly suitable.

The following examples are set forth to illustrate the basic concepts and some different embodiments of the invention. However, the invention is not in any way limited thereto.

EXAMPLE 1

In a 100 l conical blender, equipped with a doubly rotating screw, 1kg of spray maltodextrin DE 20-marketed by AVEBE, Veendam, The Netherlands-a-d 1 kg of tobacco dust (particle size distribution: 27%<425 μm, 425 μm<64%<630 μm and 630 μm<8%<850 μm) were mixed for 5 min: while 0.20 kg of ethanol was atomized over the mixture from a spray head fitted in the blender. Subsequently 6.9 kg of cut cigarette tobacco was added and mixed through. After 5 min. 0.4 kg of ethanol was atomized over the mixture followed by 0.5 kg of a 15% by weight aqueous solution of maltodextrin DE 20. Mixing was continued for another 15 min.

10 kg dry tobacco mixture was obtained comprising 69% w/w tobacco and 10% tobacco dust.

EXAMPLE 2

In the conical blender mentioned above, 0.5 kg of spray dried maltodextin DE 20 and 1 kg of the tobacco dust mentioned above, were mixed for 5 min., while 0.1 kg of propylene glycol was atomized over the mixture. Subsequently 7.8 kg of cut cigarette tobacco was added and mixed through. After 5 min. 0.2 kg of propylene glycol was atomized over the mixture followed by 0.4 kg of an aqueous solution containing 0.5% w/w of sodium carboxymethylcellulose and 2.5% w/w of saccharose. Mixing was continued for another 15 min.

10 kg dry tobacco mixture was obtained comprising 78% w/w tobacco and 10% tobacco dust. Example 3

In the conical blender 0.75 kg of spray dried maltodextrin DE 20 and 1.5 kg of tobacco dust were mixed for 5 min., while 0.15 kg of ethanol was atomized over the mixture. Subsequently 6.7 kg of cut tobacco was added and mixed through. After 5 min. 0.4 kg of ethanol was atomized over the mixture, followed by 0.5 kg of 15% w/w aqueous solution of gum arabic. Mixing was continued for another 15 min.

10 kg dry tobacco mixture was obtained comprising 67% w/w tobacco and 15% tobacco dust.

EXAMPLE 4

In the conical blender 6.1 kg of cut tobacco, 1.0 kg of tobacco dust and 2.0 kg of micro-encapsulated cocoa flavor in maltodextrin DE 20 (cocoa flavor content 24% w/w) were mixed for 15 min., while 0.4 kg of ethanol was atomized over the mixture, followed by 0.5 kg of a 15% w/w aqueous solution of gum arabic. Mixing was continued for another 15 min.

10 kg dry and strongly cocoa flavored tobacco mixture was obtained comprising 61% w/w tobacco, 10% tobacco dust and 4.8% cocoa flavor. To obtain a flavored tobacco suitable for consumption this tobacco mixture may be diluted 100–200 fold, according to taste, with unflavored tobacco.

EXAMPLE 5

In the conical blender 1.5 kg of tobacco dust and 0.36 kg of spray dried maltodextrin were mixed for 20 min., while 0.4 kg of ethanol followed by 0.09 kg of a 15% w/w aqueous solution of gum arabic were atomized over the mixture. Subsequently 7.18 kg of cut tobacco was mixed through while 0.37 kg of ethanol followed by 0.50 kg of a 15% w/w aqueous solution of gum arabic were atomized over the mixture. Mixing was continued for another 15 min.

10 kg dry tobacco mixture was obtained comprising 72% tobacco and 15% tobacco dust.

EXAMPLE 6

In the conical blender 1.0 kg tobacco dust and 0.5 kg of powdered gum arabic were mixed for 5 min., while 0.1 kg of ethanol was atomized over the mixture. Subsequently 7.5 kg of cut tobacco was mixed through. After 5 min. 0.4 kg of ethanol followed by 0.05 kg of a 15% w/w solution of gum arabic were atomized over the mixture. Mixing was continued for another 15 min.

10 kg dry tobacco mixture was obtained comprising 75% w/w tobacco and 10% tobacco dust.

We claim:

1. A process for affixing tobacco dust to a comminuted tobacco-type product selected from the group consisting of tobacco, tobacco substitute and reconstituted tobacco, comprising the steps of mixing tobacco dust, a powdered water soluble hydrocolloid, and the tobacco-type product, spraying a water miscible organic solvent over this mixture, followed by an aqueous solution of a hydrocolloid and continuing the mixing until a substantially dry product is obtained, wherein:

a. the amount of tobacco-type product is at least 60% of the weight of the total mixture;

b. the amount of tobacco dust is at most 25% of the weight of the total mixture;

c. the amount of powdered water soluble hydrocolloid is at least 20% by weight of the amount of tobacco dust;

d. the amount of water miscible organic solvent is at most 10% of the weight of the total mixture;

e. the amount of aqueous solution of a hydrocolloid is from 2 to 7% of the weight of the total mixture; wherein further the water miscible organic solvent is selected from the group consisting of ethanol, isopropanol, propylene glycol, glycerol, diethylene glycol, triethylene glycol and butylene glycol, and wherein the water soluble hydrocolloids are selected from the group consisting of vegetable gums, microbial gums, starch derivatives, cellulose derivatives, gelatin, casein, polyvinylalcohol and saccharose.

2. The process according to claim 1 wherein:

a. the amount of tobacco-type product is at least 65% of the weight of the total mixture;

b. the amount of tobacco dust is at most 20% of the weight of the total mixture;

c. the amount of powdered, water soluble hydrocolloid is at least 30% by weight of the amount of tobacco dust;

d. the amount of water miscible organic solvent is at most 6% of the weight of the total mixture.

3. The process according to claim 2 wherein the tobacco dust and the powdered hydrocolloid are first mixed together, a water miscible organic solvent is sprayed over this mixture in an amount of 20% of the weight of the mixture, subsequently adding with continuous mixing the tobacco-type product, followed by successively spraying the remainder of the organic solvent and the aqueous hydrocolloid solution over the mixture and continuing the mixing until a substantially dry product is obtained.

4. The process according to claim 3, further comprising adding an amount of 10% aqueous hydrocolloid solution after the spraying with water miscible solvent in the amount of 20% of the weight of the mixture.

5. The process according to claim 1 wherein the water soluble hydrocolloid is at least partly replaced by micro-encapsulated flavors.

6. The process according to claim 1 further comprising the step of adding an additional quantity of tobacco-type product after addition of the aqueous solution of the water soluble hydrocolloid.

7. The product comprising the material obtained by means of the process according to claim 1.

8. The product comprising the material obtained by means of the process according to claim 5.

* * * * *